US006441746B1

(12) United States Patent
Taborisskiy et al.

(10) Patent No.: US 6,441,746 B1
(45) Date of Patent: Aug. 27, 2002

(54) ACTUATING MECHANISM FOR GAUGE POINTER

(75) Inventors: Yuriy Taborisskiy, W. Bloomfield; Zinoviy Kelman, Bloomfield Hills, both of MI (US)

(73) Assignee: Yazaki North America

( * ) Notice: Subject to any disclaimer, the term of this patent is extended or adjusted under 35 U.S.C. 154(b) by 26 days.

(21) Appl. No.: 09/663,474

(22) Filed: Sep. 15, 2000

(51) Int. Cl.[7] ..... G08B 5/24

(52) U.S. Cl. ..... 340/815.78; 340/688; 73/866.1; 324/171

(58) Field of Search ..... 340/688, 691.8, 340/815.78; 73/866.1; 324/171

(56) References Cited

U.S. PATENT DOCUMENTS

| | | | | |
|---|---|---|---|---|
| 4,310,731 A | * | 1/1982 | Carlsen, II | 179/110 F |
| 5,004,976 A | | 4/1991 | Markow et al. | |
| 5,138,779 A | | 8/1992 | Earnest | |
| 5,831,820 A | | 11/1998 | Huang | |
| 5,845,598 A | | 12/1998 | Ross et al. | |
| 5,982,168 A | | 11/1999 | Westberg et al. | |
| 6,067,867 A | | 5/2000 | Glover et al. | |

* cited by examiner

*Primary Examiner*—Julie Lieu
(74) *Attorney, Agent, or Firm*—Young & Basile

(57) ABSTRACT

An actuating mechanism for a relative slow-acting vehicle gauge indicator, such as a rotatable pointer. A muscle wire driven rack gear is operatively connected to a rotatable pointer gear. The rack gear is biased to a gauge at-rest position by a spring member. Upon receiving an electrical signal from a vehicle sensor, the muscle wire contracts, moving the rack member against the spring force to drive the gauge pointer to an appropriate reading on a gauge face.

12 Claims, 2 Drawing Sheets

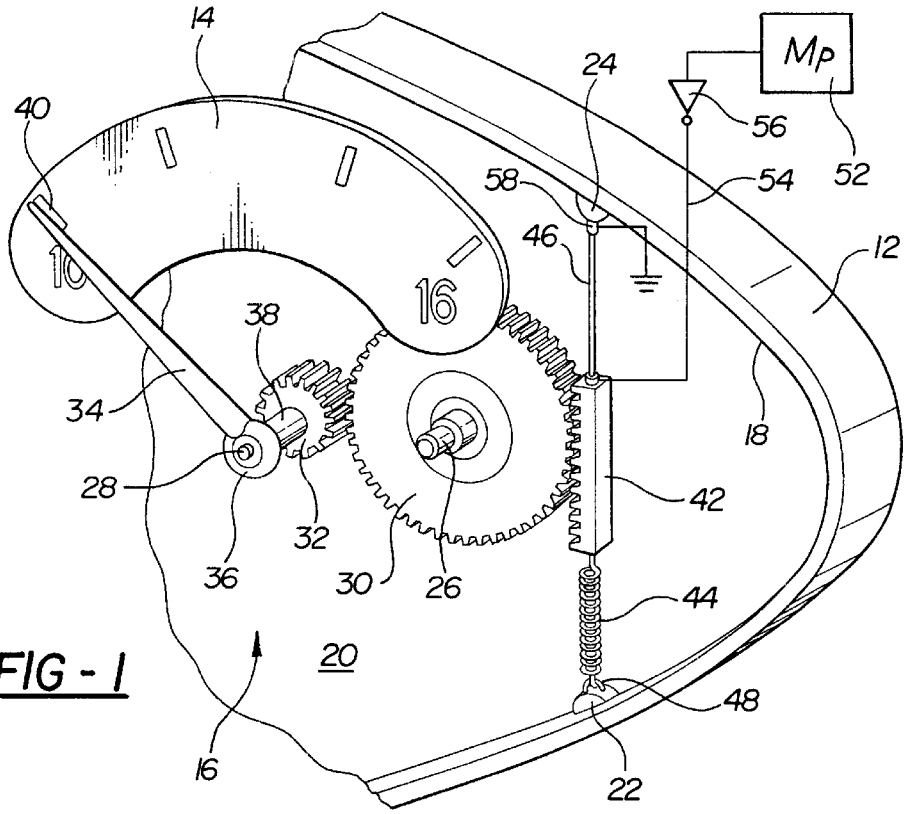
FIG - 1
FIG - 3
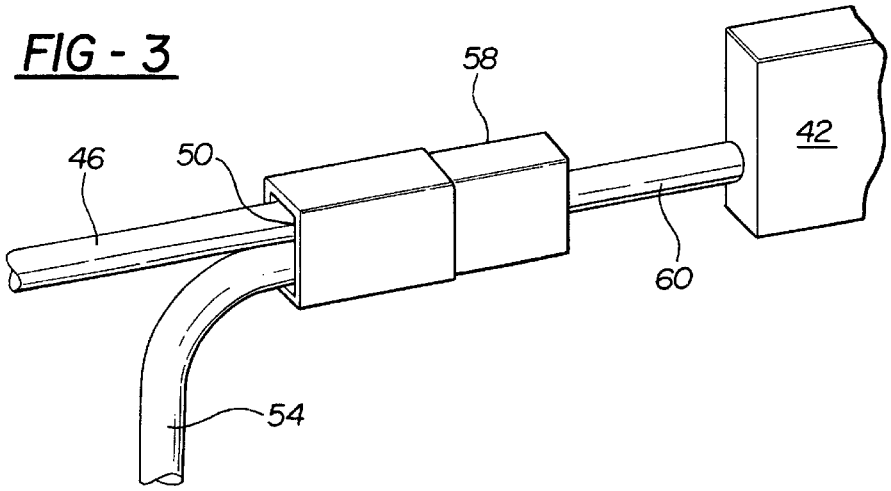

ACTUATING MECHANISM FOR GAUGE POINTER

FIELD OF THE INVENTION

The present invention is in the field of vehicle instruments and gauges, and more particularly to the mechanisms for driving gauge indicators such as pointers.

BACKGROUND OF THE INVENTION

Pointer-type gauges are common on vehicle instrument panels. They are used for both relatively instantaneous indications of vehicle operating conditions such as speed and RPM, and for relatively slow-acting indications such as oil and coolant temperature, fuel level, battery voltage, etc. It is standard practice to drive both fast-acting and slow-acting gauges with stepper motor mechanisms, such as the one illustrated in U.S. Pat. No. 5,845,598. Stepper motors are, however, overkill for slow-acting gauges. Not only do they take up a significant amount of space in increasingly crowded instrument panels, but stepper motors and their driving mechanisms are relatively expensive.

Stepper motor drive mechanisms also require relatively large microprocessors to control them. The microprocessor must manage multiple counters (one for every input) and digital drivers (one for every output) with the result that significant microprocessor capacity is assigned to managing stepper motor arrangements.

SUMMARY OF THE INVENTION

The present invention is a gauge indicator drive mechanism especially useful for gauges on vehicle instrument panels. The drive mechanism is both simple and inexpensive. It is useful primarily for slow-acting gauges such as oil and coolant temperature, fuel level, battery voltage, and the like. The drive mechanism takes up very little space and uses minimal microprocessor capacity to run it in accordance with vehicle operating conditions affecting the gauge readout.

In its preferred form, the inventive drive mechanism is a rack and gear mechanism driven by muscle wire acting against spring tension. Muscle or shape memory actuator wires are typically made from a shape memory or biometallic material such as nickel-titanium alloy, and are called "muscle wire" because they flex or shorten like muscles when electrical current is applied to them. The wire contracts quickly and silently, and when power is shut off, the wire relaxes and cools, returning to its original length. A typical muscle wire on the market is sold under the name "Flexinol", and comes in varying specifications for voltage, current, resistance, power, mass, wire length in relaxed and contracted conditions, and wire force.

The gauge indicator in a preferred form is a pointer driven by a gear, which in turn is driven by a rack operated by the muscle wire. The rack transforms the linear contracting motion of the muscle wire into a useful driving force for a gear, which can translate a relatively small amount of linear muscle wire contraction into a significant rotational motion of the pointer using various gearing between the rack and the pointer. The rack is under spring tension in its rest position, the spring tension being increased as muscle wire attached to the rack pulls the rack against the spring force to rotate the pointer gear. The muscle wire contracts in response to electrical current supplied in the form of a signal from a vehicle component or system whose condition the pointer indicates.

The electrical signal in a preferred form is received from a microprocessor, and optionally is amplified, the microprocessor sending current to the muscle wire in proportion to a sensed vehicle condition, causing the wire to contract according to the size of the current, and thereby driving the pointer in proportionate amount over a gauge face to give the appropriate reading.

These and other features and advantages of the invention will become apparent upon further reading of the specification, in light of the accompanying drawings.

BRIEF DESCRIPTION OF THE DRAWINGS

FIG. 1 is a perspective view of a muscle wire driven gear and rack mechanism in accordance with the invention, shown operatively connected to a battery voltage gauge pointer on a vehicle instrument panel.

FIG. 3 is an enlarged view of the connector arrangement shown in FIGS. 1 and 2 for electrically joining a signal wire to the muscle wire.

DETAILED DESCRIPTION OF THE ILLUSTRATED EMBODIMENT

Figure 2:
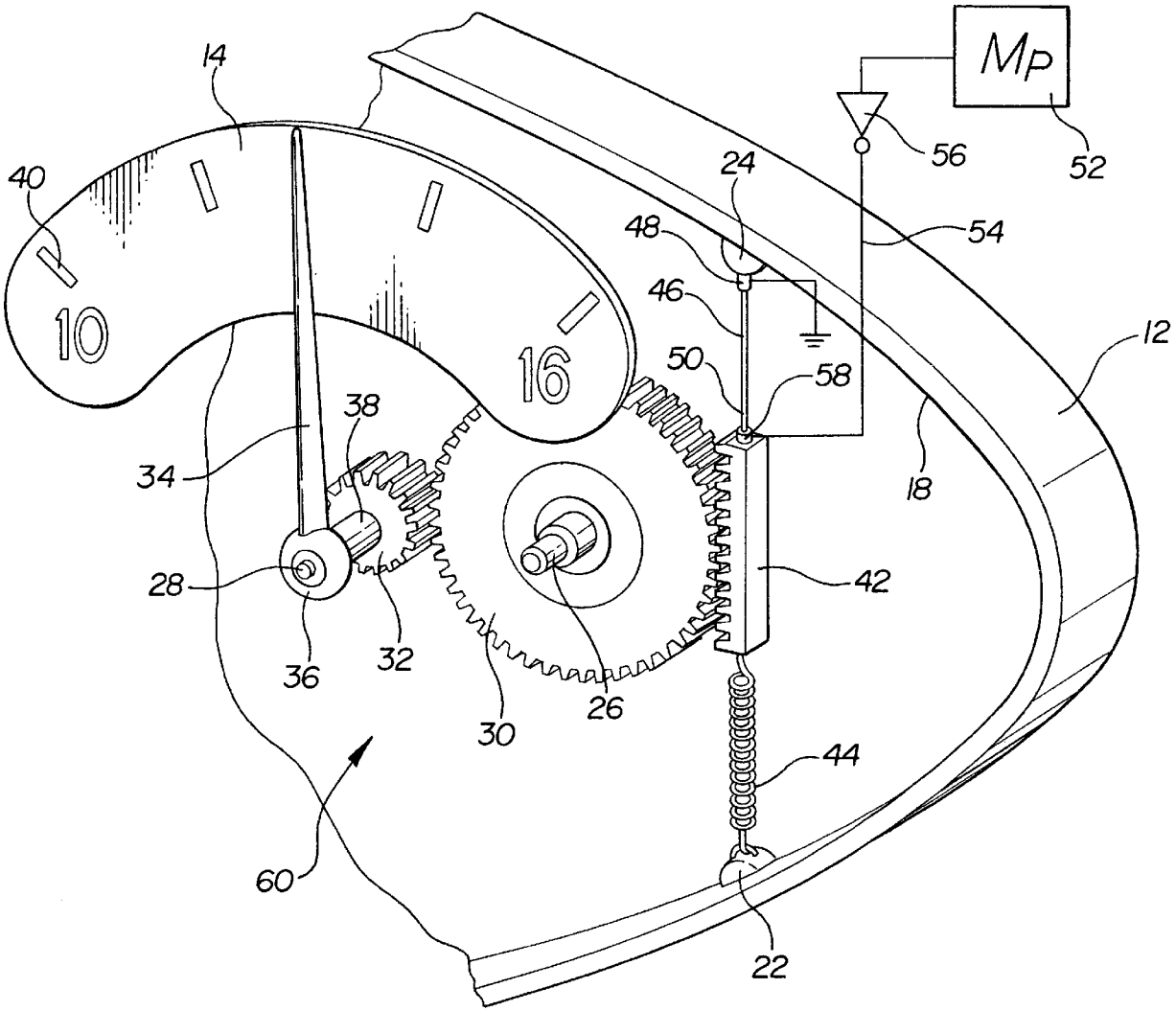
FIG. 2 illustrates the mechanism of FIG. 1 activated by muscle wire contraction in response to sensed battery voltage to move the gauge pointer to a battery voltage reading higher than that in FIG. 1.

FIG. 1 illustrates a preferred embodiment of the present invention mounted in an instrument panel housing 12 in a vehicle. Housing 12 may be an integral portion of the overall instrument panel or may be formed as a separate module adapted to be plugged into the instrument panel in known manner. A slow-acting instrument panel gauge is represented at 14, in the illustrated embodiment a battery voltage gauge, in which a pointer 34 pivots in an arc across the face of gauge 14 to point to indicia 40 indicating the state of a vehicle component or system. In the illustrated embodiment, indicia 40 on gauge 14 represent voltages from ten to sixteen volts.

Pointer 34 is operated by a pointer-operating mechanism 16 according to the present invention. The pointer-operating mechanism includes a gear 32 attached directly to the pointer shaft 38; a drive gear 30 rotatably mounted on a shaft 26 secured to the housing; and a gear rack 42 suspended by a spring member 44 and a muscle wire actuator 46 so as to engage the teeth of drive gear 30.

Although the term "pointer" is used for member 34, suggesting a needle-like device tapering to a narrow tip at the gauge indicia, it will be understood by those skilled in the art that other types of rotatable, relatively slow-acting gauge indicators can be powered by the illustrated drive mechanism.

Gear rack 42 is suspended between anchor points 22 and 24 formed in housing 12. The methods or devices for securing spring member 44 to rack 42 and to anchor 22, and for securing at least the first end 48 of muscle wire 46 to anchor point 24, may be conventional and similar. For example, opposite extremities of the spring may be hooked or screwed to the rack and anchor point.

The tension of spring member 44 tends to pull rack gear 42 downwardly as oriented in the drawings, to a rest position shown in FIG. 1 in which pointer 34 is at the low end of the gauge to denote a low battery voltage reading. This is the at-rest state of the pointer-actuating mechanism. It will be apparent to those skilled in the art that the at-rest position of the mechanism need not be at a low end of a gauge reading, but could be at the middle, at the high end, or at any other point a gauge designer may deem appropriate or necessary as an at-rest position. In this at-rest position, muscle wire 46 is in its relaxed, uncontracted state. When muscle wire 46 contracts in response to electrical current, it pulls rack gear 42 upwardly to rotate drive gear 30 counterclockwise and pointer gear 32 clockwise, thereby driving pointer 34 clockwise as shown in FIG. 2. To do this, muscle wire 46 must overcome the force of spring member 44 tending to retain the gear rack 42 in its at-rest position. As soon as the signal to the muscle wire is cut off, the muscle wire relaxes, and the spring member returns the rack gear to the at-rest position.

Muscle wire activation is controlled by a microprocessor 52 used to receive information from various sensors located on different portions of the vehicle. In the illustrated embodiment, microprocessor 52 receives a voltage signal from a sensor at the vehicle's battery in the known manner. Microprocessor 52 may be dedicated solely to the operation of mechanism 16 and gauge 40. However, because the pointer-actuating mechanism of the present invention requires only simple inputs and outputs for a microprocessor, and therefore uses relatively little microprocessor capacity, it is more likely that microprocessor 52 will be one already installed in the vehicle and controlling other functions.

Microprocessor 52 activates muscle wire 46 by providing an output voltage through a signal line or contact wire 54 based on the sensed condition, i.e., battery voltage. An amplifier 56 may be provided in signal line 54 to strengthen the signal from the microprocessor.

Referring now to FIGS. 1 and 3, signal line 54 is electrically connected to muscle wire 46 in one aperture 50 of a three-way connector 58 of known type. As shown in FIG. 3, connector 58 is mechanically secured to gear rack 42 with a non-conductive cable, wire, or thread 60. Muscle wire 46, signal line 54, and non-conductive cable 60 may all be secured in connector 58 in known fashion, for example by crimping, soldering, or with adhesive.

Although the three-way connection illustrated in FIG. 3 is a preferred method of connecting the muscle wire to the gear rack, and the signal line to the muscle wire, it will be understood that other methods of connection will be readily understood and available to those skilled in the art.

The invention as described herein is highly useful for relatively slow-acting gauges, and has the advantages of compactness, extreme simplicity, and very low cost. Since minor changes and modifications varied to fit particular operating requirements and environments will be understood by those skilled in the art, this invention is not considered limited to the specific examples chosen for purposes of illustration. The invention is meant to include all changes and modifications which do not constitute a departure from the true spirit and scope of this invention as claimed in the following claims and is represented by reasonable equivalents to the claimed elements.

Accordingly, we claim:

1. An apparatus for operating a relatively slow-acting gauge indicator in a vehicle, comprising:

a gear-driven pointer;

a muscle wire activated rack gear operatively connected to the pointer gear.

2. The apparatus of claim 1, wherein the rack gear is operatively connected to the pointer via at least one intermediate drive gear.

3. The apparatus of claim 1, wherein the rack gear is biased to an at-rest position by a spring member.

4. The apparatus of claim 1, wherein the muscle wire is electrically connected to a vehicle sensor.

5. The apparatus of claim 4, wherein the muscle wire is operatively connected to a vehicle sensor through a microprocessor.

6. The apparatus of claim 5, wherein the muscle wire is connected to the microprocessor through an amplifier.

7. An apparatus for operating a relatively slow-acting gauge indicator in a vehicle, the apparatus comprising:

a muscle wire operatively connected to a moveable gauge indicator through a gear mechanism, the muscle wire further being electrically connected to a vehicle sensor measuring a vehicle condition which the gauge indicator represents, such that electrical signals from the sensor cause the muscle wire to contract and move the gauge indicator over a gauge face visible to an operator of the vehicle.

8. The apparatus of claim 7, wherein the gauge mechanism comprises a gear attached to the indicator, and a second gear attached to the muscle wire, the second gear being operatively connected to the first gear.

9. The apparatus of claim 8, wherein the gauge indicator comprises a rotatable indicator, the first gear is attached to the rotatable indicator and is a rotatable gear, and the second gear is a rack gear connected to the muscle wire.

10. The apparatus of claim 7, wherein the gauge indicator is biased to an at-rest position by a spring member operatively connected to the gauge indicator so as to oppose the contraction of the muscle wire.

11. The apparatus of claim 7, wherein the gauge indicator is a linear motion indicator.

12. An apparatus for operating a relatively slow-acting gauge indicator in a vehicle, the apparatus comprising:

a muscle wire operatively connected to a moveable gauge indicator, the muscle wire further being electrically connected to a vehicle sensor measuring a vehicle condition which the gauge indicator represents, such that electrical signals from the sensor cause the muscle wire to contract and move the gauge indicator over a gauge face visible to an operator of the vehicle, the gauge indicator being biased to an at-rest position by a spring member operatively connected to the gauge indicator so as to oppose the contraction of the muscle wire.

* * * * *